US007182330B2

(12) United States Patent
Lindelof et al.

(10) Patent No.: US 7,182,330 B2
(45) Date of Patent: Feb. 27, 2007

(54) INTELLIGENT AUTONOMOUS SHEET FEEDER FOR THE INFEED OF A PRINTER

(75) Inventors: Harold Peter Lindelof, Eden Prairie, MN (US); Leon David Wirth, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 399 days.

(21) Appl. No.: 10/314,521

(22) Filed: Dec. 9, 2002

(65) Prior Publication Data

US 2004/0108645 A1 Jun. 10, 2004

(51) Int. Cl.
*B65H 3/52* (2006.01)

(52) U.S. Cl. ..... 271/138; 271/124; 271/121

(58) Field of Classification Search ..... 271/124, 271/121, 138, 127, 126; 270/110
See application file for complete search history.

(56) References Cited

U.S. PATENT DOCUMENTS 4,957,243 A * 9/1990 Kanagaki et al. ..... 241/34
4,961,566 A * 10/1990 Labombarde ..... 271/35
5,026,042 A * 6/1991 Miller ..... 271/119
5,401,013 A * 3/1995 Hurd et al. ..... 271/124
5,924,686 A * 7/1999 Jacobson et al. ..... 271/3.17
6,193,230 B1 * 2/2001 Tung-Ying ..... 271/124
6,435,499 B1 * 8/2002 Tomatsu ..... 271/147
6,794,633 B2 * 9/2004 Iwasaki ..... 250/221

* cited by examiner

*Primary Examiner*—Patrick Mackey
*Assistant Examiner*—Kaitlin Joerger
(74) *Attorney, Agent, or Firm*—Altera Law Group, LLC

(57) ABSTRACT

Disclosed herein is a sheet feeder for a printer. The sheet feeding device feeds a single sheet into an infeeder of a printer without communicating with the printer. The sheet feeder is equipped with a sensor for detecting when the printer is able to accept a sheet. The sheet feeder is equipped with a programmable timing device that causes the sheet feeder to wait a predetermined amount of time before inserting another sheet into the printer. The predetermined amount of time corresponds to the amount of time needed for the printer to complete printing on a sheet after the sensor has detected that the printer is able to accept a sheet into the infeeder of the printer. The sheet feeder is configured with a gate having an adjustable gap in close proximity to a tray containing a stack of sheets. The gate permits only a single sheet to be fed into the infeeder of the printer at a time. The gate has a guide post having a radius of curvature curving toward the gap to urge the stack of sheets toward the gap in the gate. The sheet feeder has an adjustable tray designed to compensate for non-uniform profiles of a stack of sheets. The adjustable tray urges the stack of sheets into the gap in an upward motion to prevent jamming of the sheets in the sheet feeding device.

18 Claims, 11 Drawing Sheets

INTELLIGENT AUTONOMOUS SHEET FEEDER FOR THE INFEED OF A PRINTER

BACKGROUND OF THE INVENTION

1. Field of the Invention

This invention relates in general to an automatic sheet feeding device for a printer, and more particularly to a sheet feeding device that inserts a single sheet at a time into an infeeder of a printer without communicating with the printer.

2. Description of Related Art

There are numerous printers available for printing standard sized pages, e.g., letter (8½"×11"), A4 (210 mm×297 mm) and legal (8½"×14"). However, when a user desires to print sheets having dimensions different than the standard sized sheets, i.e., large sheets or sheets having an adhesive strip or other raised portions thereon, or a combination thereof, the user encounters several problems. Initially, the user must obtain a printer capable of printing the non-standard sized sheets. Then, the user has the option of feeding a single sheet at a time into the infeeder of the printer by hand or obtain a sheet feeding device that is capable of feeding the non-standard sized sheets into the printer usually through a rear entry bypass infeed port. The user must also be concerned with the capability of feeding a single sheet at a time into the printer when the thickness of the sheet is non-uniform, i.e., one edge of the sheet is thicker than another edge which will generally skew when printed.

Feeding the sheets by hand is a time consuming process and is labor intensive, i.e., someone must stand there and monitor the printer, feeding a sheet into the printer when a sheet has been printed.

It can be seen that there is a need for an intelligent sheet feeding device that is able to feed sheets into the infeeder of a printer without communicating with the printer, i.e., an intelligent sheet feeder that is able to know when the printer is ready to receive a subsequent sheet. It can be seen that there is a need for a sheet feeding device that does not require substantial programming in order to operate successfully in conjunction with a printer without communicating directly with the printer. It can be seen that there is a need for a user friendly sheet feeding device for feeding sheets into a printer without constant monitoring by a user. It can be seen that there is a need for a sheet feeding device that is capable of feeding sheets having a non-uniform thickness without jamming the printer or the sheet feeding device.

SUMMARY OF THE INVENTION

To overcome the limitations in the prior art described above, and to overcome other limitations that will become apparent upon reading and understanding the present specification, the present invention discloses a sheet feeder for a printer. The sheet feeding device feeds a single sheet at a time into the infeeder of a printer without communicating with the printer.

The present invention solves the above-described problems by providing a sheet feeding device that inserts a single sheet at a time into an infeeder of a printer without communicating with the printer.

An apparatus in accordance with the principles of the present invention includes a sheet feeder for a printer including a feeder tray for holding a plurality of sheets. The feeder tray having a first end located near the printer and a second end located distant from the printer. The feeder tray being configured to pivot at a pivot point toward the second end of the tray. The feeder tray being biased upwardly toward the first end of the tray. The first end of the tray when upwardly biased being disposed in a plane above a parallel plane passing through the pivot point. The sheet feeder also includes a gate defined by a gap, the gap being adjustably configurable to permit a single sheet to pass through the gap. The feeder inserts one sheet at a time from the tray through the gap into an infeeder of the printer without communicating with the printer.

Another aspect of the present invention is that the gate includes a gating bar situated above a gate post, the gating bar and the gate post are spaced apart from one another forming the gap, and the gate post is vertically adjustable to define a width of the gap.

Another aspect of the present invention is that the gate includes a gate post having a radius of curvature that permits the feeder tray to move in a curved arc to place a stack of sheets in frictional contact with a drive wheel to urge a sheet through the gap in the gate.

Another aspect of the present invention is that the sheet feeder includes a sensor to detect that the printer is able to receive a sheet for printing.

Another aspect of the present invention is that the sensor sends a signal to activate a timing circuit, the timing circuit causes a drive motor to rotate a drive wheel a predetermined number of revolutions after a predetermined time delay interval, the drive wheel frictionally engaging and urging a sheet through the gap in the gate and into the infeeder of the printer.

Another aspect of the present invention is that the sensor comprises an optical sensor having a light emitting element and a light detecting element, and wherein the light detecting element detects light that originates from the light emitting element and is reflected off of a reflecting surface.

Another aspect of the present invention is that when the light detecting element of the sensor detects reflected light, the sensor sends a timing circuit activation signal.

Another apparatus in accordance with the present invention includes a sheet feeder for a printer including a feeder tray for holding a stack of sheets. The tray having a front edge to be positioned adjacent the printer. The sheet feeder also includes a gate proximate said front edge, the gate having a guide post interposed to form at least a portion of the tray proximate the front edge. The guide post being configured to guide the stack toward a gap configured to permit a single sheet to pass therethrough.

Another aspect of the present invention is that the gate post further has a radius of curvature provided in a surface adjacent the feeder tray to align the sheets in the stack.

Another aspect of the present invention is that the gate post further includes an adjustment lever for adjusting the vertical position of the gate post to define a width of the gap.

Another aspect of the present invention is that the sheet feeder further comprises a sensor for detecting that the printer is able to accept a sheet for printing.

Another aspect of the present invention is that the sensor sends a signal to a timing circuit indicating that the printer is able to accept a sheet for printing.

Another aspect of the present invention is that the guide post has a surface in abutment with at least a portion of the stack and having a radius of curvature to cause the stack to separate into single sheets as they approach the gap.

Another apparatus in accordance with the present invention includes a sheet feeder for a printer having an infeed passage accessible from outside the printer, including a means for detecting that the printer may accept a sheet. The sheet feeder also includes a means for advancing a single sheet into an infeed passage of the printer and a means for delaying advancement of a subsequent sheet into the infeed passage for a predetermined amount of time to allow the first sheet to clear the infeed passage. When the means for detecting detects that the printer may accept a sheet for printing the means for delaying advancement prevents the means for advancing from advancing a sheet into the infeeder of the printer until the predetermined amount of time has elapsed without receiving any electronic control signals from the printer.

Another apparatus in accordance with the present invention includes a sheet feeder for a printer having an infeed passage accessible from outside the printer, including an optical sensor for optically determining that the printer may accept a first sheet. The sheet feeder also includes a driven roller in frictional contact with the sheet and a programmable timing circuit for causing a delay in initiating advancement of a sheet into the infeed passage, the delay being predetermined to correspond to an amount of time required for the printer to complete printing of the first sheet. The optical sensor determining that the printer may accept a sheet for printing triggers the timing circuit to wait until a further predetermined amount of time has elapsed before advancing a sheet into the infeed passage of the printer without receiving any communication from the printer.

A method in accordance with the present invention includes a method for properly sequencing the feeding of a sheet into a printer having an infeed passage without receiving communication from the printer, the method including, associating an autonomous sheet feeder adjacent a printer and loading the sheet feeder with a plurality of sheets. The method also includes programming a timing circuit with a predetermined delay time and arranging a detector to detect when the printer may accept a sheet for printing. The sheet feeder supplies the printer with a single sheet at a time without receiving communication from the printer by detecting that the printer may accept a sheet, waiting a predetermined amount of time, activating a drive to advance a single sheet into an infeeder of the printer, detecting that the printer may not accept a sheet during printing on the sheet, detecting that the printer infeed passage may accept another sheet and printing a desired number of sheets.

Another method in accordance with the present invention includes a method for feeding a single sheet of a stack into a printer, the method including associating a sheet feeder adjacent a printer, loading a stack of sheets into a tray in the sheet feeder, biasing the tray so that the tray is vertically inclined toward an infeed passage of the printer, adjusting a gap to permit a single sheet to be advanced through the gap and urging the stack of sheets toward a guide post having a concave radius of curvature configured to curve toward the gap thereby separating the stack into single sheets as they approach the gap.

Another method in accordance with the present invention includes a method for feeding an uneven stack of sheets into a printer, the method including associating an autonomous sheet feeder adjacent a printer, loading a plurality of sheets into a pivotable tray in the sheet feeder, the sheets having side edges and one of the side edges has a cross sectional thickness that is greater than a cross sectional thickness of another of the side edges so that a stack is higher on one side than another, the stack of sheets slants horizontally from a thick side to a thin side, biasing the tray so that the tray is vertically inclined toward an infeeder of the printer, biasing the tray so that the stack of sheets is horizontally oriented with respect to the infeeder of the printer, adjusting a gap to permit the side edge having a greater cross sectional thickness of a single sheet to be advanced through the gap, guiding a sheet into the gap with a guide post having a radius of curvature configured to curve toward the gap and driving the sheet forward into the infeed passage only at the thicker side.

The sheet feeder is equipped with a sensor for detecting when the printer is able to accept a sheet. The sheet feeder is equipped with programmable timing circuitry that causes the sheet feeder to wait a predetermined amount of time before inserting another sheet into the printer. The predetermined amount of time corresponds to the amount of time needed for the printer to complete printing on a sheet after the sensor has detected that the printer is able to accept a sheet into the infeeder of the printer.

The sheet feeder is configured with a gate having an adjustable gap in close proximity to a tray containing a stack of sheets. The gate permits only a single sheet to be fed into the infeeder of the printer at a time. The gate has a guide post having a radius of curvature curving toward the gap to urge the stack of sheets toward the gap in the gate. The sheet feeder has an adjustable tray designed to compensate for non-uniform profiles of a stack of sheets. The adjustable tray urges the stack of sheets into the gap in an upward motion to prevent jamming of the sheets in the sheet feeding device.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout.

DETAILED DESCRIPTION OF THE INVENTION

In the following description of the exemplary embodiment, reference is made to the accompanying drawings which form a part hereof, and in which is shown by way of illustration the specific embodiment in which the invention may be practiced. It is to be understood that other embodiments may be utilized as structural changes may be made without departing from the scope of the present invention.

The present invention provides a sheet feeder for a printer. The sheet feeding device feeds a single sheet into an infeeder of a printer without communicating with the printer. The sheet feeder is equipped with a sensor for detecting when the printer is able to accept a sheet and a programmable timing circuit that causes the sheet feeder to wait a predetermined amount of time before inserting another sheet into the printer. The predetermined amount of time corresponds to the amount of time needed for the printer to complete printing on a sheet after the sensor has detected that the printer is able to accept a sheet into the infeeder of the printer.

The sheet feeder is configured with a gate having an adjustable gap in close proximity to a tray containing a stack of sheets. The gate permits only a single sheet to be fed into the infeeder of the printer at a time. The gate has a guide post having a radius of curvature curving toward the gap to urge the stack of sheets toward the gap in the gate.

The sheet feeder has an adjustable tray designed to compensate for non-uniform profiles of a stack of sheets. The adjustable tray urges the stack of sheets into the gap in an upward motion to prevent jamming of the sheets in the sheet feeding device.

Figure 1:
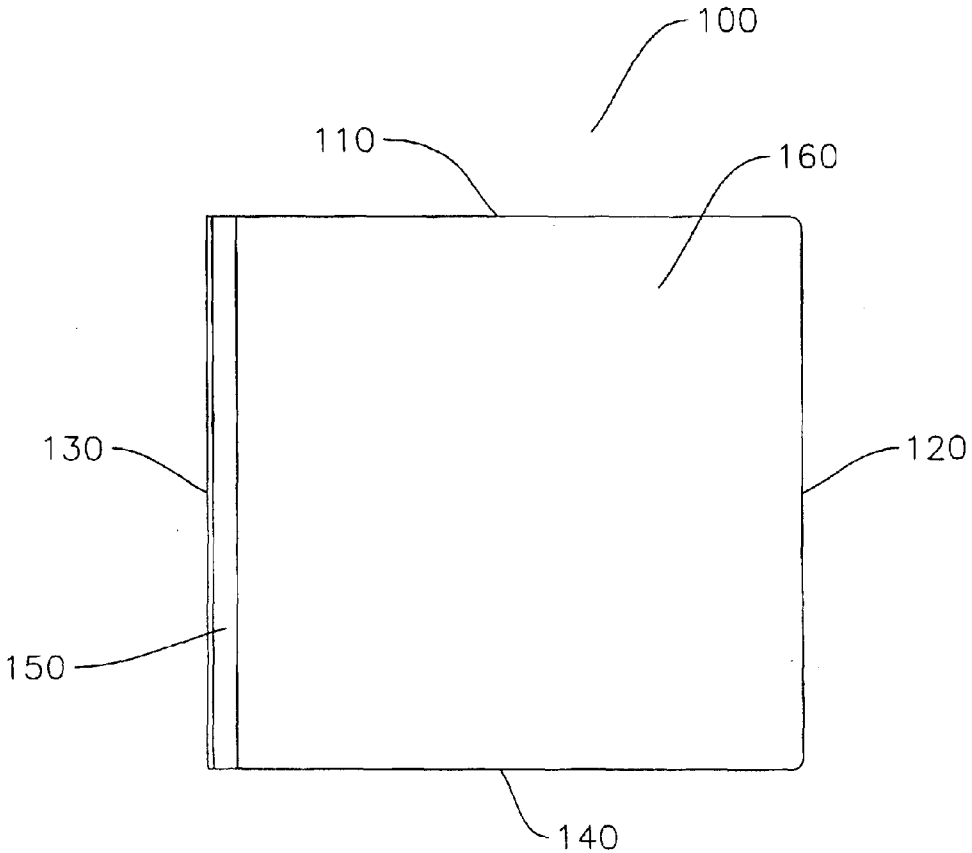
FIG. 1 illustrates a bottom view of a sheet for use in the sheet feeder according to an embodiment of the present invention.

FIG. 1 illustrates a bottom view of a sheet 100 for use in the sheet feeder according to an embodiment of the present invention. In FIG. 1, the sheet 100 has a rear edge 110, a forward edge 140 and a bottom surface 160. The top surface is not shown in FIG. 1. The sheet 100 also has an adhesive strip 150 disposed along side edge 130 and an opposing side edge 120. The sheet 100 may receive printed indicia on the top surface (not shown), the bottom surface 160 or a combination of both in accordance with a desired print function.

Figure 2:
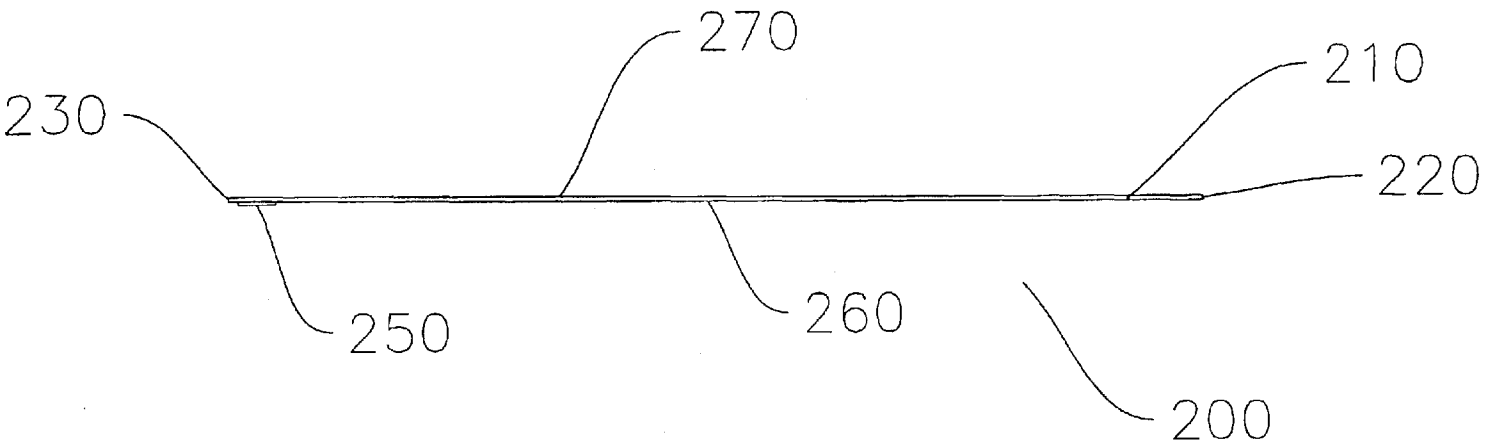
FIG. 2 illustrates an end view of a sheet for use in the sheet feeder according to an embodiment of the present invention.

FIG. 2 illustrates a side view of a sheet 200 for use in the sheet feeder according to an embodiment of the present invention. In FIG. 2, the sheet 200 is shown having a top surface 270, a bottom surface 260 and an adhesive strip 250 disposed along one edge 230 and an opposing edge 220. The sheet 200 is shown having an edge profile 210 illustrating that the sheet 200 has a thickness due to the sheet itself. It is further illustrated that the edge 230 having the adhesive strip 250 adhered therealong combine to display a thickness greater than the thickness of the sheet alone.

Figure 3:
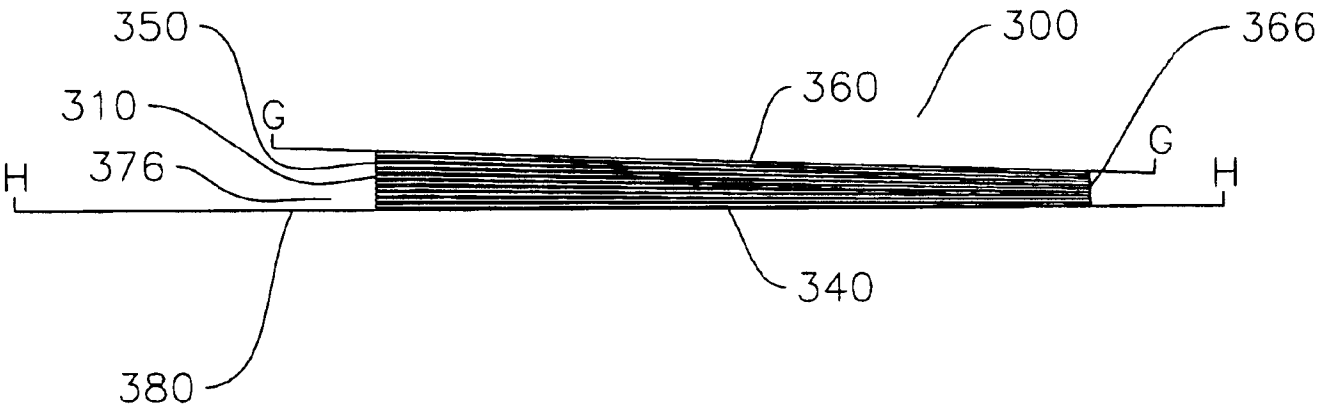
FIG. 3 illustrates an end view of a stack of sheets for use in the sheet feeder according to an embodiment of the present invention.

FIG. 3 illustrates a side view of a stack 300 of sheets for use in the sheet feeder according to an embodiment of the present invention. In FIG. 3, a stack 300 of individual sheets 310 each having an adhesive strip 350 adhered thereto is illustrated. The bottom 340 of the stack 300 is shown oriented along a horizontal axis 380 (H to H). The top 360 of the stack 300 is shown oriented along an axis 390 (G to G). The side 376 of the stack 300 where each individual sheet 310 has an adhesive strip 350 adhered thereto is thicker than the side 366 of the stack 300 where each sheet 310 is not provided with an adhesive strip 350.

Figure 4:
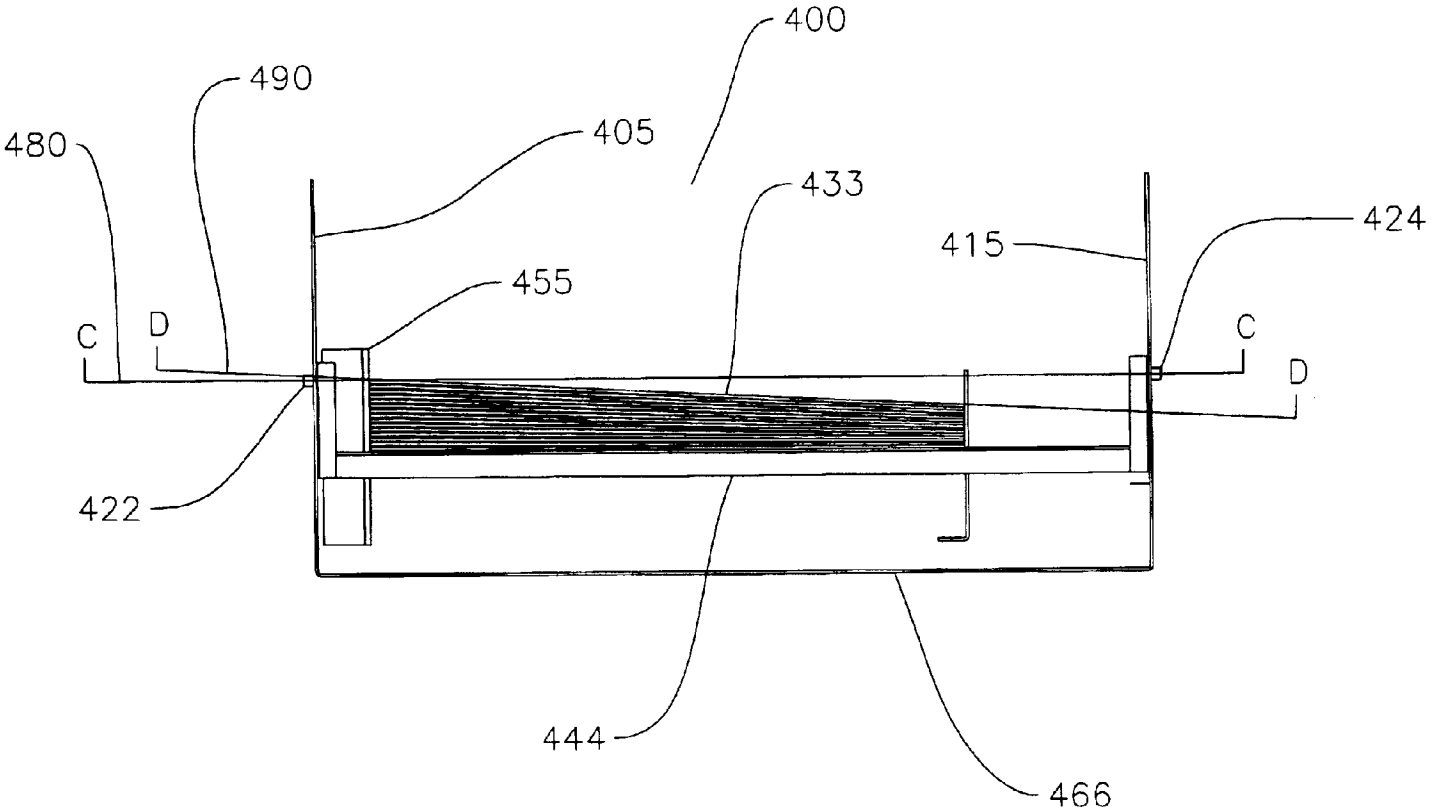
FIG. 4 illustrates an end view of a stack of sheets placed in a tray in the sheet feeder according to an embodiment of the present invention.

FIG. 4 illustrates a side view of a stack 433 of sheets placed in a tray 444 in the sheet feeder according to an embodiment of the present invention. In FIG. 4, the stack of sheets 433 has been placed into the tray 444 and is illustrated being oriented horizontally along horizontal axis 480 (C to C). The axis 480 (C to C) passes horizontally through pivoting connections 422, 424, respectively. The pivoting connections 422, 424 are pivotally engaged in side walls 405, 415 at an end of the sheet feeder disposed distant from the printer (not shown). External to the tray are aligning guide members 455 that serve to align the stack 433 of sheets and to permit the bottom of the tray 444 to be disposed at a location lower than the location of the pivoting connections 422, 424. The top of the stack 433 is illustrated oriented along sloping axis 490 (D to D).

Figure 5:
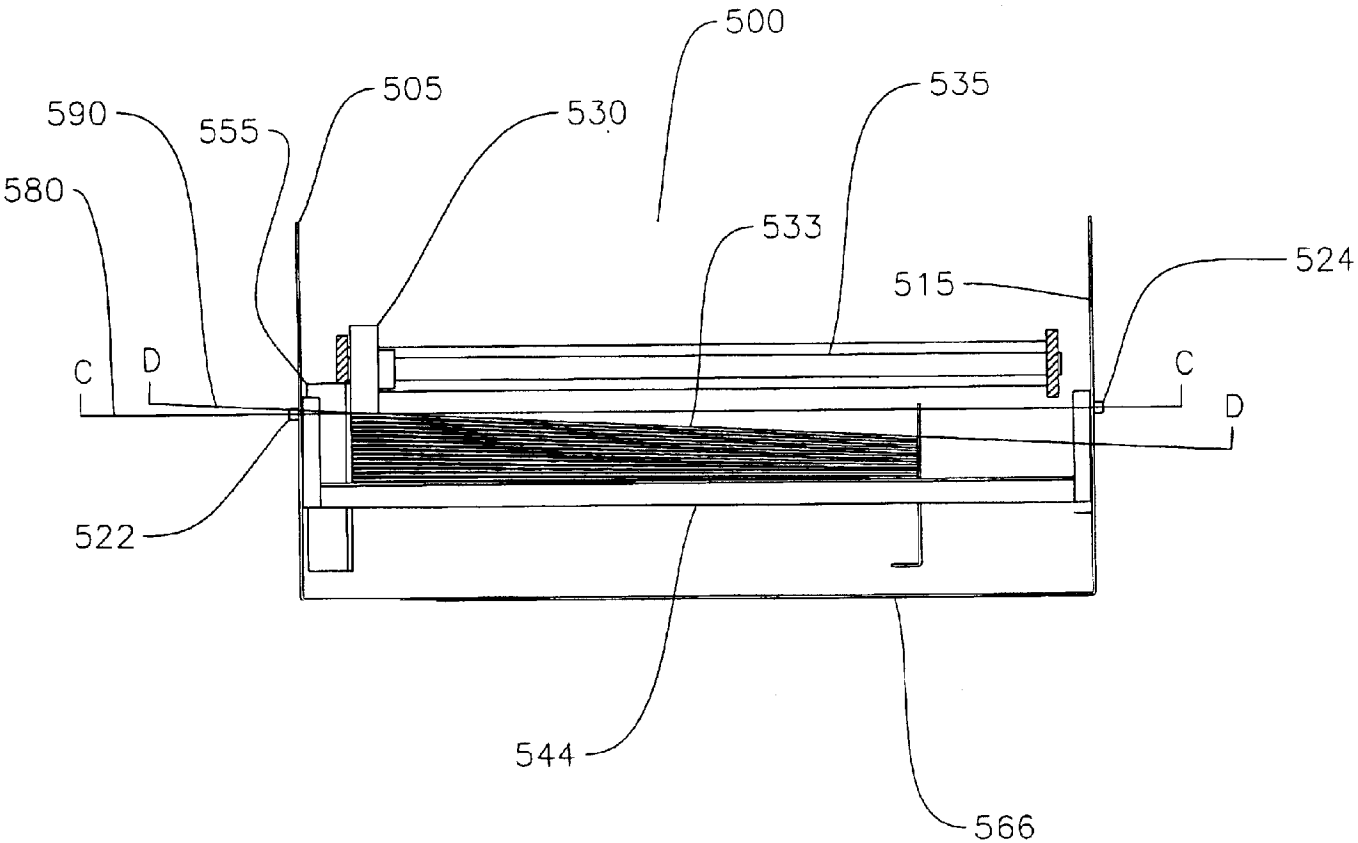
FIG. 5 illustrates an end view of a stack of sheets placed in a tray in the sheet feeder and being in engagement with a drive wheel according to an embodiment of the present invention.

FIG. 5 illustrates another side view of a stack 533 of sheets placed in a tray 544 in the sheet feeder 500 according to an embodiment of the present invention. In FIG. 5, the stack of sheets 533 has been placed into the tray 544 and is illustrated being oriented horizontally along horizontal axis 580 (C to C). The axis 580 (C to C) passes horizontally through pivoting connections 522, 524, respectively. The pivoting connections 522, 524 are pivotally engaged in side walls 505, 515 at an end of the sheet feeder disposed distant from the printer (not shown). External to the tray 544 are aligning guide members 555 that serve to align the stack 533 of sheets and to permit the bottom of the tray 544 to be disposed at a location lower than the location of the pivoting connections 522, 524. The top of the stack 533 is illustrated oriented along sloping axis 590 (D to D). Drive wheel 530 is shown engaging the top of the stack of sheets 533 along the edge having the adhesive strip. The adhesive strip is disclosed as being oriented along an edge of the sheets, however it may be applicable to have the adhesive strip located at another location upon the sheets. The drive wheel 530 is adjustably mounted to adjustment beam 535 such that the drive wheel 530 may be moved to facilitate engagement with the stack 533 at various locations therealong.

Figure 6:
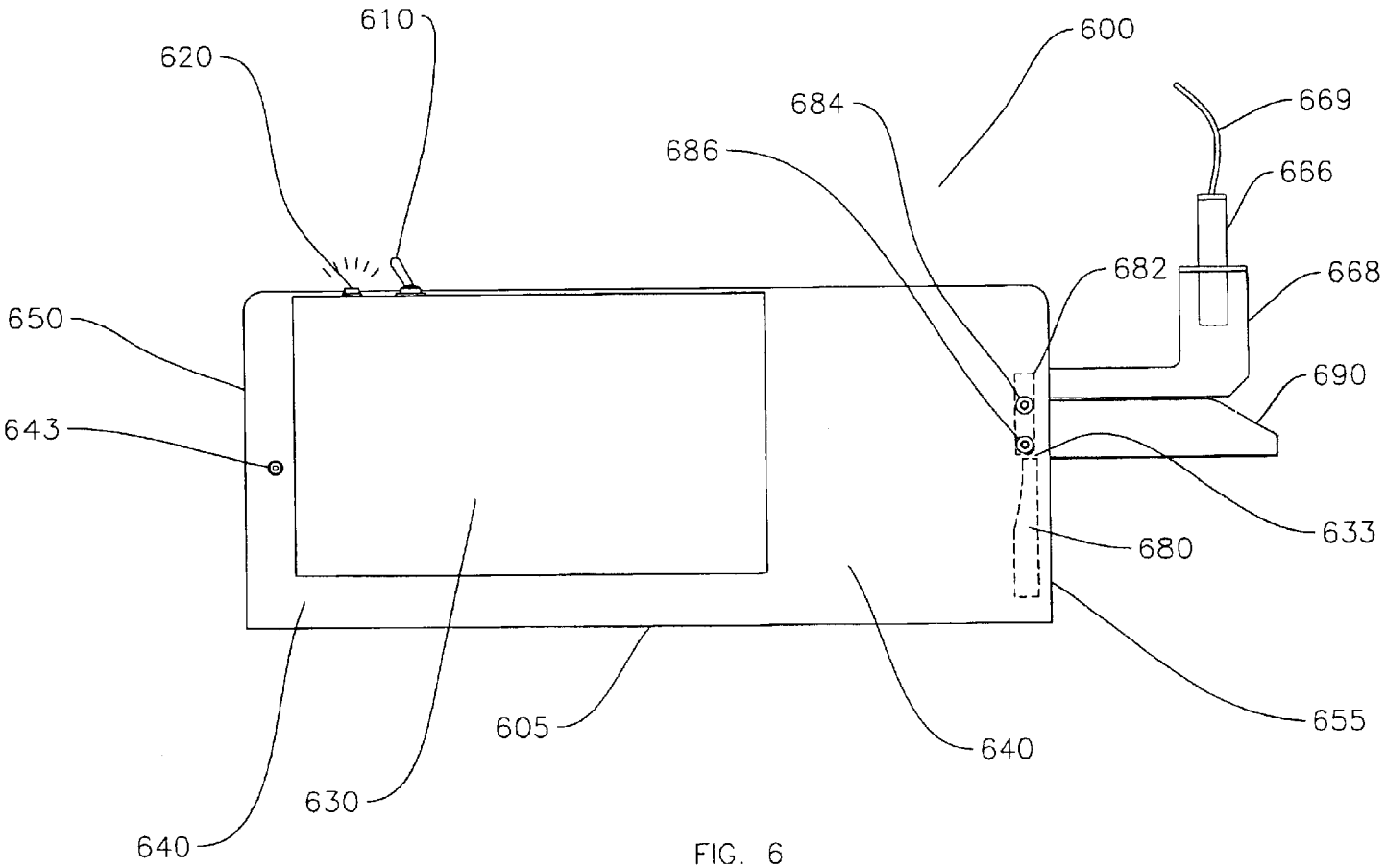
FIG. 6 illustrates an exterior side view of the sheet feeder according to an embodiment of the present invention.

FIG. 6 illustrates an exterior side view of the sheet feeder 600 according to an embodiment of the present invention. In FIG. 6, an exterior side wall 640 of the sheet feeder 600 is illustrated. The far end 650 of the side wall 640, is disposed distant from the printer (not shown) and the near end 655 of the side wall 640 is disposed adjacent the printer (not shown). The sheet feeder 600 is shown having a bottom 605 extending along the length of the sheet feeder 600. The sheet feeder 600 is shown provided with a separate compartment 630 exterior to the sheet feeder. The separate compartment 630 at least contains a drive motor, timing circuitry and power supply components. The compartment 630 is shown provided with an on/off switch 610 and a light 620 that indicates the status of the sheet feeder 600 when in operation. The drive motor, timing circuitry and the light 620 will be discussed in further detail below. At the near end 655 of the sheet feeder 600, a sensor 666 is illustrated. The sensor 666 is shown mounted to the sheet feeder 600 through sensor mounting member 668, The sensor 666 is operatively connected to the timing circuitry enclosed in the compartment 630. The operation of the sensor 666 will be more fully discussed below. A gating bar 682 (shown in dotted lines) is connected through connections 684, 686 to the side wall 640 of the sheet feeder 600 along the near end 655 of the side wall 640. A guide rail 690 is shown extending from the end of the sheet feeder 600 located proximate the printer (not shown). A pair of guide rails 690 guide a sheet into the infeeder of a printer (not shown). The gating bar 682 (shown in dotted lines) and an adjustable gate post 680 (shown in dotted lines) cooperate to form an adjustable gap 633 (shown in dotted lines). The gap 633 is adjustable to permit a single sheet at a time to be fed into the printer (not shown) from the sheet feeder 600.

Figure 7:
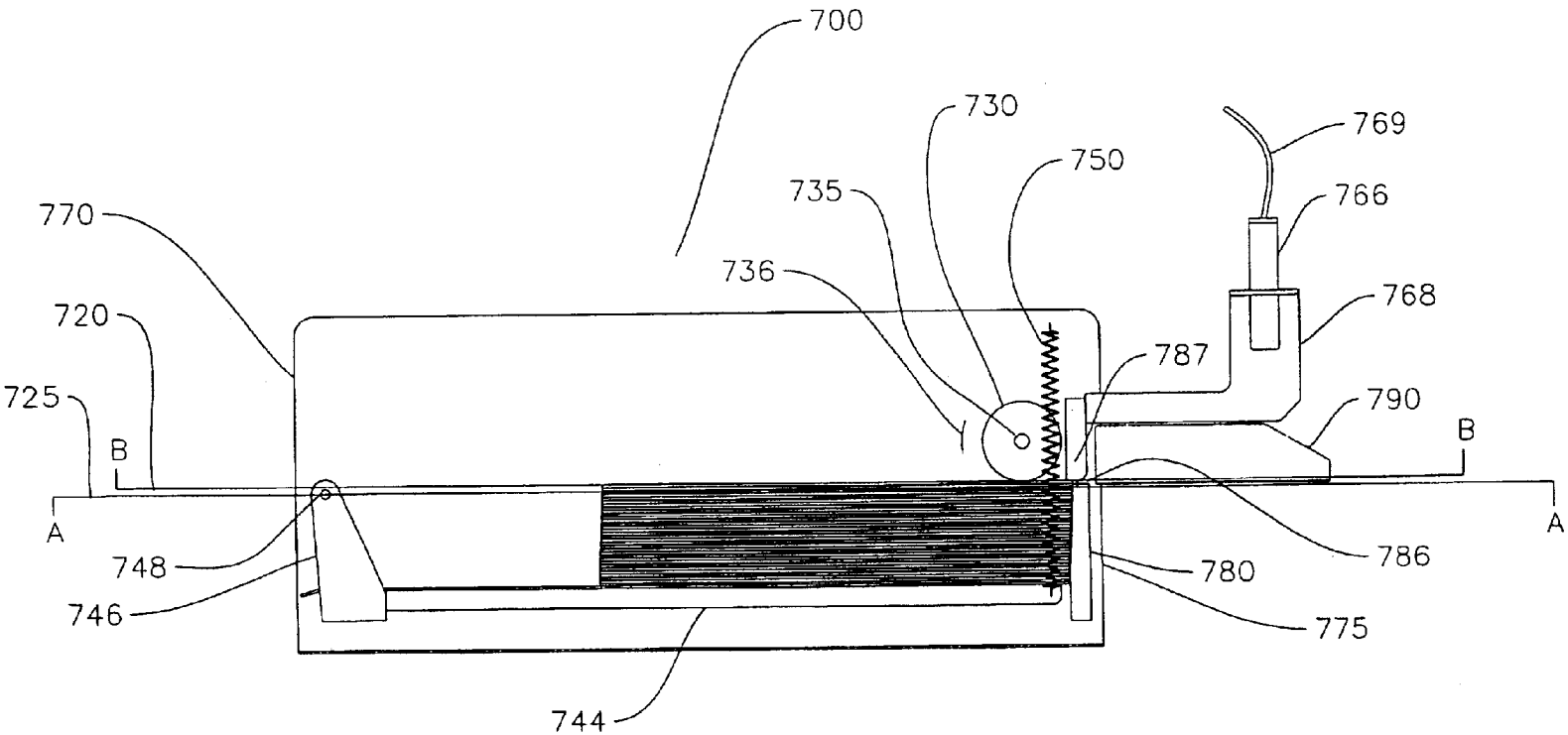
FIG. 7 illustrates a cutaway side view of the sheet feeder according to an embodiment of the present invention.

FIG. 7 illustrates a cutaway side view of the sheet feeder 700 according to an embodiment of the present invention. In FIG. 7, the interior of the sheet feeder 700 is disclosed. At the far end 770 of the sheet feeder 700, the tray 744 is shown pivotally connected by member 746 and through pivoting connection 748 to the side wall (not shown) of the sheet feeder 700.

At the near end 775 of the sheet feeder 700, the tray 744 is biased upwardly by spring 750. Spring 750 applies a biasing force to the front end of the tray 744 sufficient to cause the top sheet of a stack of sheets to engage drive wheel 730. Drive wheel 730 rotates on axle 735 in the direction of arrow 736. In operation, the drive wheel frictionally engages the top sheet of a stack of sheets and urges the sheet through the gap 786 between the gating bar 787 and the adjustable gate post 780 and into a pair of guide rails 790. The guide rails 790 are arranged to feed the sheet into the infeeder of the printer (not shown). FIG. 7 also discloses the sensor 766 being mounted in sensor mounting member 768 and being operatively connected to the timing circuitry through cable 769.

The horizontal axis 725 (A to A) bisecting the pivoting connection 748 is illustrated as being disposed below the horizontal axis 720 (B to B) passing through the gap 786. The orientation of the tray 744 disclosed sloping upwardly from the bottom of the tray 744 at the far end 770 to the bottom of the gap 786 at the near end 775 facilitates the feeding of the sheets into the gap 786 and eventually into the infeeder of the printer (not shown).

Orienting the tray 744 in the manner disclosed in FIG. 7 overcomes at least one disadvantage. In prior devices, interaction of a drive wheel and a sheet has been known to cause a curling of the sheet. This curling effect has been attributed to undesirable forces accumulating at the point of interaction between the sheet and the drive wheel. Having the tray oriented horizontally with respect to the drive wheel or in another instance having the tray oriented where the end of the tray most distant from the drive wheel is elevated above the location of interaction of the sheet and the drive wheel is suspected of producing the undesirable surface tensions and pressure on the sheet which cause the curling of the sheet to occur. Curling of the sheet causes the sheet to miss the infeeder of an associated printer and results in sheets jamming and thus a cessation of a printing session. Jamming is labor intensive and requires substantial user interaction with the device. The present invention avoids this problem by having the tray oriented so that the sheets are fed in an upwardly sloping manner from the sheet feeder into the printer.

Figure 8:
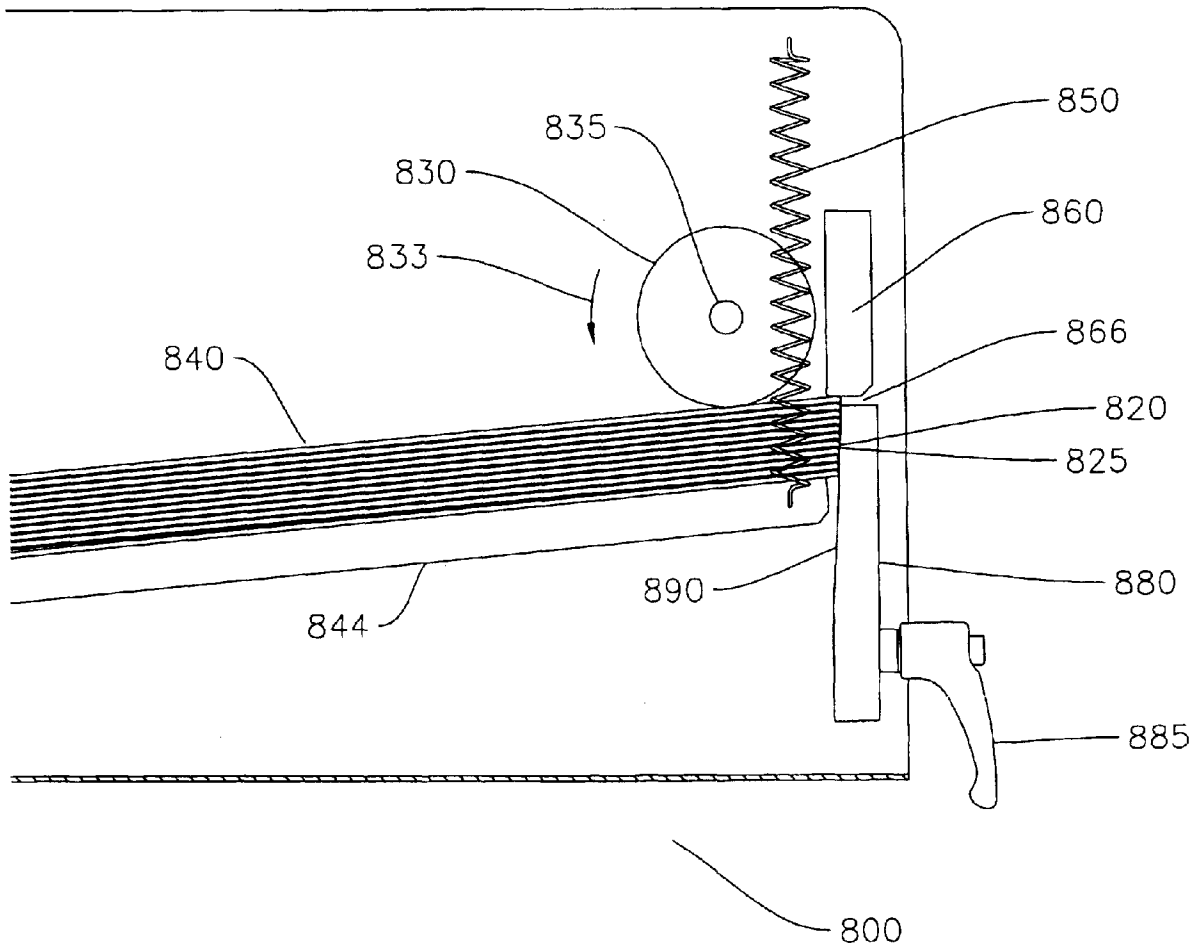
FIG. 8 illustrates a cutaway of a portion of a side view of the of the sheet feeder loaded with sheets according to an embodiment of the present invention.

FIG. 8 illustrates an enlarged cutaway of a portion of a side view of the of the sheet feeder 800 loaded with a stack 840 of sheets 820 according to an embodiment of the present invention. In FIG. 8, a stack 840 of sheets 820, each sheet having an adhesive strip 825 disposed along an edge thereof, is illustrated. The drive wheel 830 rotates on axle 835 in the direction of arrow 833. The drive wheel 830 frictionally engages the top sheet 820 of the stack 840 of sheets. The tray 844 is biased upwardly at the end near the printer (not shown) by spring 850 in the area adjacent the point of interaction (shown generally) between the drive wheel 830 and the top sheet.

The gating bar 860 and the adjustable gate post 880 cooperate to form gap 866. The gate post 880 is adjustable vertically through adjustment handle 885. In operation, the gap 866 is adjusted to permit a single sheet 820 at a time to pass through the gap 866. The edge of the sheet 820 having the adhesive strip 825 adhered thereto passes through the gap 866, i.e., the gap 866 is adjusted to permit a total thickness comprising the thickness of the sheet and the thickness of the adhesive strip 825 to pass through with a minimal additional amount of clearance.

For example, the sheet 820 may be 0.011" thick and the adhesive strip 825 may be 0.004" thick to make a total thickness of 0.015" thick. The gap 866 may be set to 0.020" thick, thus providing a 0.005" clearance thickness. Setting the gap 866 in this manner prevents two sheets passing through that gap 866 simultaneously. It is understood that the dimensions of the sheet provided here are for example only and that the sheet feeder is adaptable to a variety of sheet thicknesses.

The gate post 880 is provided with a stack engaging surface having a radius of curvature 890 as illustrated in FIG. 8. Providing the gate post 880 with a stack engaging surface having a radius of curvature 890 serves at least two functions. The radius of curvature 890 in the stack engaging surface of the gate post 880 permits the tray 844 to smoothly move upwardly and downwardly in a curving arc motion adjacent the gate post 880. Smooth movement of the tray 844 is essential to ensuring that the spring 850 may adequately bias the tray 844 upwardly and ultimately the stack 840 of sheets upwardly. The spring 850 should not be resisted in performing the biasing function, thus ensuring that the sheets make good frictional contact with the drive wheel 830. Additionally, the radius of curvature 890 of the stack engaging surface of the gate post 880 aligns the front portion of the stack of sheets against the gate post 880 in a curving arc shape. Having the front of the stack of sheets aligned along the gate post 880 prevents jamming of the sheets by ensuring that a sheet is aligned with the opening of the gap 866.

Figure 9:
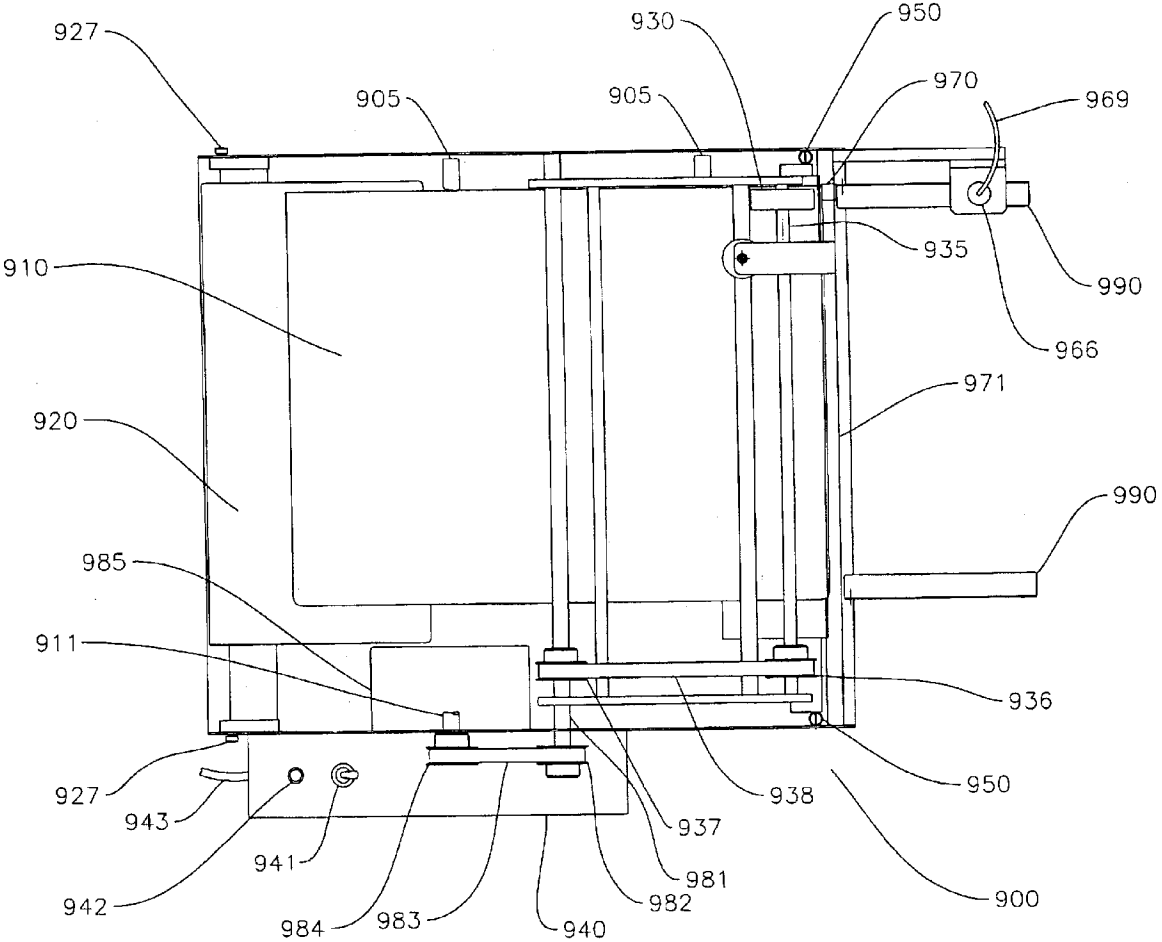
FIG. 9 illustrates a top view of the sheet feeder according to an embodiment of the present invention.

FIG. 9 illustrates a top view of the sheet feeder 900 according to an embodiment of the present invention. In FIG. 9, the operation of the sheet feeder 900 can be described. A stack 910 of sheets is shown residing upon tray 920. The stack 910 is smoothly aligned against aligning guide members 905. The tray 920 is pivotally connected to the side walls of the sheet feeder via pivoting connections 927. The tray 920 is biased upwardly at the near end by springs 950. Springs 950 bias the stack 910 of sheets into frictional engagement with drive wheel 930. Drive wheel 930 rotates on axle 935. Axle 935 is driven by drive wheel 936 which is connected by a belt drive 938 to another drive wheel 937. Drive wheel 937 rotates on axle 981, which is driven by wheel 982 which is connected by another drive belt 983 to another drive wheel 984. Drive wheel 984 rotates on axle 911 which is driven by a drive motor (not shown) enclosed in interior compartment 985. The sheet feeder 900 is provided with an on/off switch 941 and an indicator light 942 for displaying the status of the sheet feeder 900. The sheet feeder is provided with an electrical cord 943 to plug into a standard electricity outlet.

At the end nearest the printer (not shown), the sheet feeder 900 is provided with a pair of adjustable guide rails 990 which serve to guide the sheet into the printer after the sheet has proceeded through the gate assembly 970 and under gating bar 971. The guide rails 990 may be formed of a shiny reflective material.

The sensor 966 is a light sensor having a light emitting element and a light sensing element combined in the sensor 966. The sensor 966 is operative connected via cable 969 to timing circuitry enclosed in the exterior compartment 940. In operation, the sensor 966 emits light. If the light is reflected back to the sensor 966, the sensor detects the intensity of the light being detected. When the detector does not detect a reflected light or the intensity of the light detected significantly changes the sensor 966 is aware of the changes. The sensor 966 is able to detect changes in the intensity of detected light. In the embodiment illustrated in FIG. 9, the sensor 966 is mounted over the shiny reflective guide rail 990. However, the sensor 966 may be mounted in proximity to the printer or at another locations as required.

When the sheet feeder 900 is turned on, the sensor 966 detects reflected light from the guide rail 990. The sensor 966 sends a signal to the timing circuitry enclosed in the exterior compartment indicating that the printer (not shown) is ready to receive a sheet. The timing circuit waits a predetermined interval of time and then turns the drive motor a specified period of time. The predetermined interval of time may be calculated beforehand wherein the timing circuit may be programmed with the calculated delay time interval. The drive motor, enclosed within interior compartment 985, turns axle 911 which turns drive wheel 984, turns drive belt 983, turns drive wheel 982, which rotates axle 981, turns drive wheel 937, turns drive belt 938, turns drive wheel 936, which rotates on axle 935 and turns drive wheel 930. Drive wheel 930 being frictionally engaged with the top sheet of stack 910 urges the edge of the sheet having the adhesive strip adhered thereto through gate assembly 970 and under the gate bar 971. The sheet moves into guide rails 990 and at some point blocks the reflected light or decreases the intensity of the light detected by the sensor 966. The sensor 966 indicates to the timing circuitry that the printer is no longer able to receive a sheet wherein the timing circuitry will wait until another signal is received indicating that the printer is again able to receive a sheet. Meanwhile, the sheet is advanced a predetermined period of time out of the sheet feeder and is picked up by the infeeder of the printer. The printer then controls the motion of the sheet during the printing process. At some point, the sheet moves beyond the reflective guide rail 990 and the sensor 966 detects the reflected light again or the increase in the intensity of detected light and send another signal to the timing circuitry indicating that the printer is able to receive a sheet.

When the sheet feeder 900 is turned on the indicator light 942 may be turned on. When a safety cover (not shown) is open, the light may blink slowly indicating that the sheet feeder is not currently operable. When a sheet has jammed in the sheet feeder, indicated by the sensor not detecting any change in the status of the reflected intensity for a predetermined amount of time, the indicator light 942 may blink rapidly to indicate user intervention is required.

Figure 10:
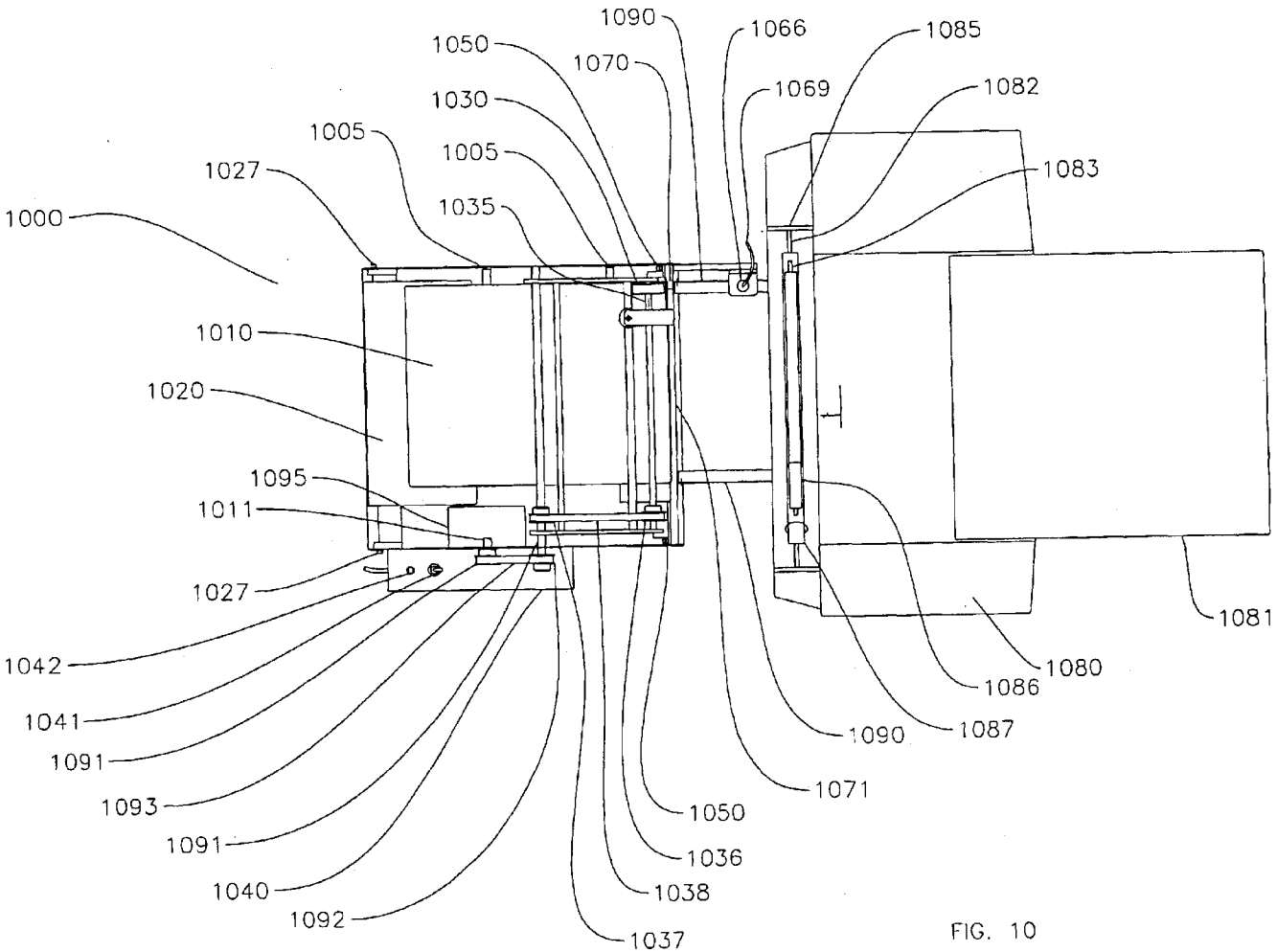
FIG. 10 illustrates a top view of the sheet feeder adjacent a printer according to an embodiment of the present invention.

FIG. 10 illustrates a top view of the sheet feeder 1000 adjacent a printer 1080 according to an embodiment of the present invention. In FIG. 10, the operation of the sheet feeder 1000 can be described. A stack 1010 of sheets is shown residing upon tray 1020. The stack 1010 is smoothly aligned against aligning guide members 1005. The tray 1020 is pivotally connected to the side walls of the sheet feeder via pivoting connections 1027. The tray 1020 is biased upwardly at the near end by springs 1050. Springs 1050 bias the stack 1010 of sheets into frictional engagement with drive wheel 1030.

Drive wheel 1030 rotates on axle 1035. Axle 1035 is driven by drive wheel 1036 which is connected by a belt drive 1038 to another drive wheel 1037. Drive wheel 1037 rotates on axle 1091, which is driven by wheel 1092 which is connected by another drive belt 1093 on axle 1011 which is driven by a drive motor (not shown) enclosed in interior compartment 1095. The sheet feeder 1000 is provided with an on/off switch 1041 and an indicator light 1042 for displaying the status of the sheet feeder 1000 disposed on an outer surface of exterior compartment 1040.

At the end nearest the printer 1080, the sheet feeder 1000 is provided with a pair of adjustable guide rails 1090 which serve to guide the sheet into the printer 1080 after the sheet has proceeded through the gate assembly 1070 and under gating bar 1071. The guide rails 1090 may be formed of a shiny reflective material.

The sensor 1066 is a light sensor having a light emitting element and a light sensing element combined in the sensor 1066. The sensor 1066 is operatively connected via cable 1069 to timing circuitry enclosed in the exterior compartment 1040.

In operation, the sensor 1066 emits light. If the light is reflected back to the sensor 1066, the sensor detects the intensity of the light being detected. When the detector does not detect reflected light or the intensity of the light detected significantly changes the sensor 1066 detects the changes. The sensor 1066 is able to detect changes in the intensity of detected light. In the embodiment illustrated in FIG. 10, the sensor 1066 is mounted over the shiny reflective guide rail 1090. However, the sensor 1066 may be mounted in proximity to the printer 1080 or at another locations as required.

When the sheet feeder 1000 is turned on, the sensor 1066 detects reflected light from the guide rail 1090. The sensor 1066 sends a signal to the timing circuitry enclosed in the exterior compartment 1040 indicating that the printer 1080 is ready to receive a sheet. The timing circuit waits a predetermined interval of time and then turns the drive motor a specified period of time. The predetermined interval of time may be calculated beforehand wherein the timing circuit may be programmed with the calculated delay time interval.

The drive motor turns axle 1011 which turns drive wheel 1094, turns drive belt 1093, turns drive wheel 1092, rotates axle 1091, turns drive wheel 1037, turns drive belt 1038, turns drive wheel 1036, which rotates axle 1035 and turns drive wheel 1030. Drive wheel 1030 being frictionally engaged with the top sheet of stack 1010 urges the edge of the sheet having the adhesive strip adhered thereto through gate assembly 1070 and under the gate bar 1071.

The sheet moves onto guide rails 1090 and at some point blocks the reflected light or decreases the intensity of the light detected by the sensor 1066. The sensor 1066 indicates to the timing circuitry that the printer 1080 is no longer able to receive a sheet wherein the timing circuitry will wait until another signal is received indicating that the printer 1080 is again able to receive a sheet.

Meanwhile, the sheet is advanced a predetermined period of time out of the sheet feeder 1000 and is picked up by feed rollers 1087 and 1086 of infeeder 1085 of the printer 1080. The feed rollers 1086, 1087 are mounted on axles 1082 and 1083 which are connected to a drive mechanism inside the printer 1080. The printer 1080 controls the motion of the sheet during the printing process.

At some point, the sheet moves beyond the location where the light from the sensor 1066 is focused on the reflective guide rail 1090 and the sensor 1066 detects the reflected light again or an increase in the intensity of detected light. The sensor 1066 then sends another signal to the timing circuitry indicating that the printer 1080 is able to receive a sheet. Upon completion of printing a sheet, the sheet is expelled from the printer 1080 onto printer collection tray 1081.

When the sheet feeder 1000 is turned on the indicator light 1042 may be turned on. When a safety cover (not shown) is open, the indicator light 1042 may blink slowly indicating that the sheet feeder 1000 is not currently operable. When a sheet has jammed in the sheet feeder 1 000, indicated by the sensor 1066 not detecting any change in the status of the reflected intensity for a predetermined amount of time, the indicator light 1042 may blink rapidly to indicate user intervention is required.

Figures 11A, 11B:
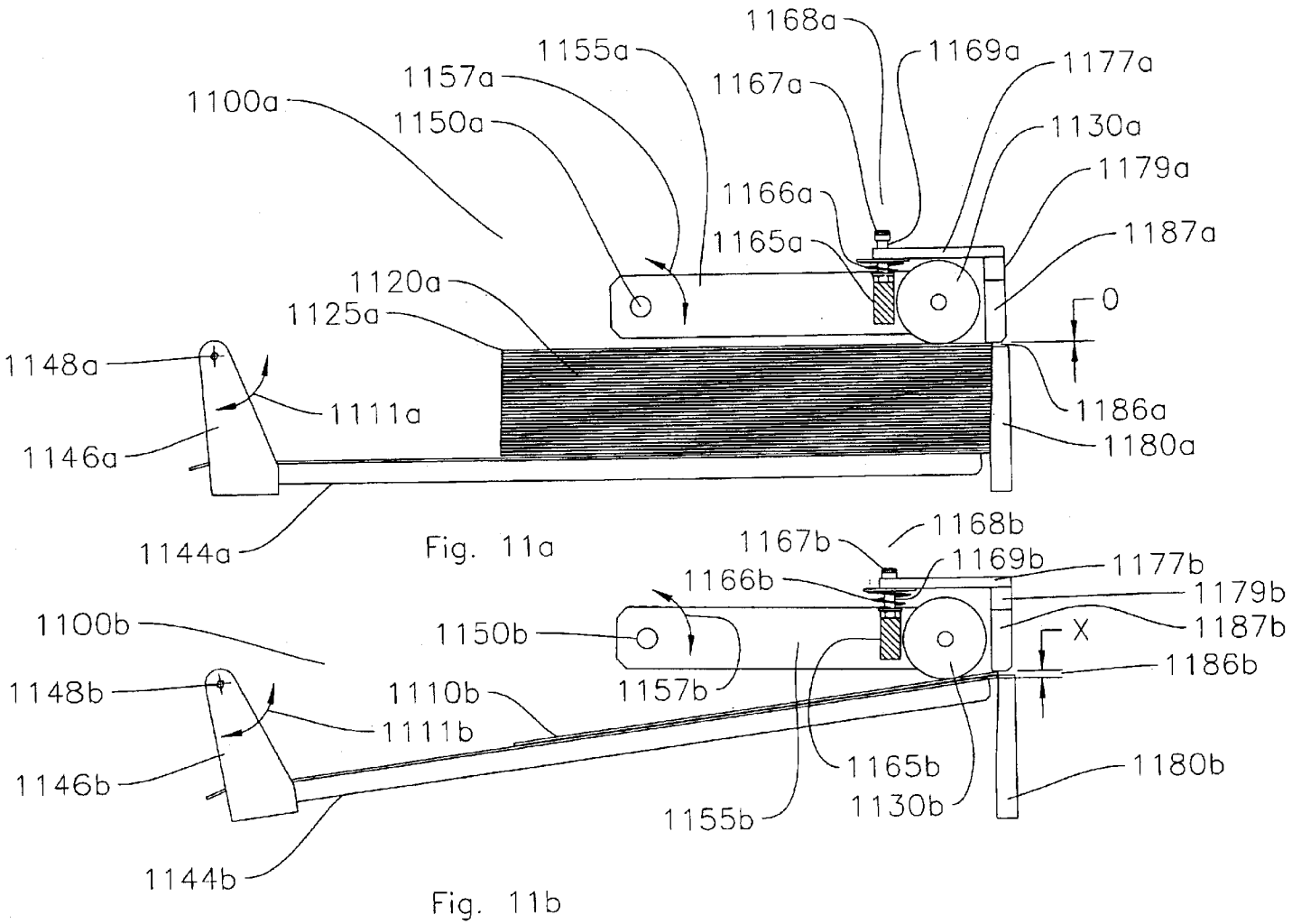
FIG. 11*a* illustrates an interior side view of the sheet feeder having a variable tension compensater and drive wheel engagement with a full stack of sheets.
FIG. 11*b* illustrates an interior side view of the sheet feeder having a variable tension compensater and drive wheel engagement with a depleted stack of sheets.

FIG. 11*a* illustrates an interior side view of the sheet feeder 1100*a* having a variable tension compensater 1155*a* and drive wheel 1130*a* engagement with a full stack 1120*a* of sheets 1125*a*. In FIG. 11*a*, a full stack 1120*a* of sheets are placed in the tray 1144*a*. The full stack of sheets is oriented generally horizontally with the gap 1186*a* between the gating bar 1187*a* and the adjustable gate post 1180*a*. The angle of approach of a sheet toward the gap 1186*a* is nearly zero degrees.

As the stack of sheets is depleted, the tray 1144*a* accommodates the depletion by pivoting on arm 1146*a* about a pivot point corresponding to pivoting connection 1148*a*. The pivoting motion is oriented along line 1111*a* and results in the angle of approach of a sheet toward the gap 1186*a* increasing as the stack is depleted. In order to prevent slippage and ensure frictional engagement between the stack 1120*a* of sheets and the drive wheel 1130*a*, the sheet feeder 1100*a* is provided with a variable tension compensater 1155*a*.

The variable tension compensater 1155*a* includes a beam pivotable about pivot point 1150*a* with motion oriented along line 1157*a*. Adjacent the drive wheel 1130*a* on the compensater 1155*a* is a tensioning device 1168*a*. The tensioning device 1168*a* has a mounting portion 1165*a* connected to the compensater 1155*a* and a post 1169*a* oriented to pass through a hole in bracing arm 1177*a*. The bracing arm 1177*a* is mounted to mounting beam 1179*a*. The post 1169*a* is configured to move up and down within the hole in the bracing arm 1177*a*.

A conical spring 1166*a* encircles the post 1169*a* and biases the compensater 1155*a* downwardly causing the drive wheel 1130*a* to maintain consistent frictional engagement with the stack 1120*a*. The biasing motion of the conical spring 1166*a* is downwardly limited by stop member 1167*a* located at the top of the post 1169*a*. In operation, when the tray 1144*a* is loaded with a full stack 1120*a* of sheets, the conical spring 1166*a* is compressed, as shown in FIG. 11*a*, but maintains a downwardly biasing force on the compensater 1155*a* and the drive wheel 1130*a*. The conical spring 1166*a* forces the drive wheel 1130*a* down to compensate for a reduced stack height and a change in the angle of approach of the sheets toward the gap 1186*a* as the stack of sheets is reduced and becomes depleted.

FIG. 11*b* illustrates an interior side view of the sheet feeder 1100*b* having a variable tension compensater 1155*b* and drive wheel 1130*b* engagement with a nearly depleted stack 1110*b* of sheets. In FIG. 11*b*, the stack 1110*b* of sheets is now oriented generally at some angle with respect to the horizontal but generally directed toward the gap 1186*b* between the gating bar 1187*b* and the adjustable gate post 1180*b*. The angle of approach of a sheet toward the gap 1186*b* has deviated substantially from the horizontal orientation, near zero degrees, when the stack was full. The angle of approach is continuously changing as each sheet is removed from the stack, until the stack is completely depleted.

The tray 1144*b* is shown accommodating the nearly depleted stack by pivoting on arm 1146*b* about a pivot point corresponding to pivoting connection 1148*b*. The pivoting motion is oriented along line 1111*b*. In order to prevent slippage and ensure frictional engagement between the final sheets in the stack 1110*b* and the drive wheel 1130*b*, the sheet feeder 1100*b* is shown provided with a variable tension compensater 1155*b*.

The variable tension compensater 1155*b* includes a beam pivotable about pivot point 1150*b* with motion oriented along line 1157*b*. Adjacent the drive wheel 1130*b* located at the other end of the compensater 1155*b* is a tensioning device 1168*b*. The tensioning device 1168*b* has a mounting portion 1165*b* connected to the compensater 1155*b* and a post 1169*b* oriented to pass through a hole in bracing arm 1177*b*. The bracing arm 1177*b* is mounted to mounting beam 1179*b*. The post 1169*b* is configured to move up and down within the hole in the bracing arm 1177*b*.

A conical spring 1166*b* encircles the post 1169*b* and biases the compensater 1155*b* downwardly causing the drive wheel 1130*b* to maintain consistent frictional engagement with the remaining sheets in the stack 1110*b*. The biasing motion of the conical spring 1166*b* is downwardly limited by stop member 1167*b* located at the top of the post 1169*b*. In operation, when the tray 1144*b* is nearly depleted of sheets, the conical spring 1166*b* maintains a downwardly biasing force on the compensater 1155*b* and the drive wheel 1130*b* ensuring that all the sheets are presented to the printer for printing. The conical spring 1166*b* forces the drive wheel 1130*b* down to compensate for a reduced stack height and a change in the angle of approach of the sheets toward the gap 1186*b* as the stack of sheets is reduced and becomes depleted.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A sheet feeder for a printer comprising:

a feeder tray for holding a plurality of sheets, the feeder tray having first end located near the printer and a second end located distant from the printer, the feeder tray being configured to pivot at a pivot point toward the second end of the tray, the feeder tray being biased upwardly toward the first end of the tray, the first end of the tray when upwardly biased being disposed in a plane above a parallel plane passing through the pivot point; and a gate defined by a gap, the gap being adjustably configurable to permit a single sheet to pass through the gap, wherein the feeder inserts one sheet aat a time from the tray through the gap into an infeeder of the printer without communicating with the printer, and wherein the gate comprises a gating bar situated above a gate post, the gating bar and the gate post spaced apart from one another forming the gap and the gate post is vertically adjustable to define a width of the gap.

2. A sheet feeder for a printer comprising:

a feeder tray for holding a plurality of sheets, the feeder tray having first end located near the printer and a second end located distant from the printer, the feeder tray being configured to pivot at a pivot point toward the second end of the tray, the feeder tray being biased upwardly toward the first end of the tray, the first end of the tray when upwardly biased being disposed in a plane above a parallel plane passing through the pivot point; and a gate defined by a gap, the gap being adjustably configurable to permit a single sheet to pass through the gap, wherein the feeder inserts one sheet at a time from the tray through the gap into an infeeder of the printer without communicating with the printer, and wherein the gate comprises a gate post having a radius of curvature that permits the feeder tray to move in a curving arc to place a stack of sheets in frictional contact with a drive wheel to urge a sheet through the gap in the gate.

3. The sheet feeder for a printer according to claim 1, wherein the sheet feeder comprises sensor to detect that the printer is able to receive a sheet for printing.

4. The sheet feeder for a printer according to claim 3, wherein the sensor sends a signal to activate a timing circuit, the timing circuit causes a drive motor to rotate a drive wheel a predetermined time interval after a predetermined time delay interval, the drive wheel frictionally engaging and urging a sheet through the gap in the gate and into the infeeder of the printer.

5. The sheet feeder for a printer according to claim 4, wherein the sensor comprises an optical sensor having a light emitting element and a light detecting element, and wherein the light detecting element detects light that originates from the light emitting element and is reflected off of a reflecting surface.

6. The sheet feeder for a printer according to claim 5, wherein when the light detecting element of the sensor detects reflected light, the sensor sends a timing circuit activation signal.

7. A sheet feeder for a printer comprising:

a feeder tray for holding a stack of sheets, said tray having a front edge to be positioned adjacent the printer;

feeder tray being upwardly inclined toward the front edge of the tray so that the tray will be inclined at an upward angle; and a gate proximate said front edge, wherein the gate at least comprises a gate post proximate the front edge of the feeder tray, the gate post configured to guide the stack toward a gap configured to permit a single sheet to pass through the gap, and wherein the gate post further having a radius of curvature provided in a surface adjacent the feeder tray to align the sheets in the stack.

8. The sheet feeder for a printer according to claim 7, wherein radius of curvature is an non flat surface.

9. The sheet feeder for a printer according to claim 7, wherein the gate post further comprises an adjustment lever for adjusting the vertical position of the gate post to define a width of the gap.

10. The sheet feeder for a printer according to claim 7, wherein the sheet feeder further comprises a sensor for detecting that the printer is able to accept a sheet for printing.

11. The sheet feeder for a printer according to claim 10, wherein the sensor sends a signal to a timing circuit indicating that the printer is able to accept a sheet for printing.

12. A sheet feeder for a printer comprising:

a feeder tray for holding a stack of sheets, said tray having a front edge to be positioned adjacent the printer; feeder tray being upwardly inclined toward the front edge of the tray so that the tray will be inclined at an upward angle and a gate proximate said front edge, the gate at least comprising a gap and a guide post, wherein the guide post having a surface in abutment with at least a portion of the stack and having a radius of curvature to cause the stack to separate into single sheets as they approach the gap.

13. A sheet feeder having a feeder tray with a front edge, for a printer having an infeed passage accessible from outside the printer, the sheet feeder comprising:

means for upwardly inclining said front edge of said tray so that the tray will be inclined at an upward angle means for detecting that the printer may accept a sheet;

means for advancing a single sheet into an infeed passage of the printer;

means for delaying advancement of a subsequent sheet into the infeed passage for a predetermined amount of time to allow the first sheet to clear the infeed passage;

wherein when the means for detecting detects that the printer may accept a sheet for printing the means for delaying advancement prevents the means for advancing from advancing a sheet into the infeeder of the printer until the predetermined amount of time has elapsed without receiving any electronic control signals from the printer.

14. A sheet feeder for a printer having an infeed passage accessible from outside the printer, comprising:

an optical sensor for optically determining that the printer may accept a first sheet;

a driven roller in frictional contact with the sheet;

a programmable timing circuit for causing a delay in initiating advancement of a sheet into the infeed passage, the delay being predetermined to correspond to a sufficient amount of time for the printer to completely print the first sheet and to b capable of accepting a subsequent sheet, wherein the optical sensor determining that the printer may accept a sheet for printing triggers the timing circuit to wait until a further predetermined amount of time has elapsed before advancing a sheet into the infeed passage of the printer without receiving any communication from the printer.

15. A method for feeding a single sheet of a stack into a printer, the method comprising:

physically associating a sheet feeder adjacent a printer;

loading a stack of sheets into a tray in the sheet feeder;

biasing the tray so that the tray is vertically inclined toward an infeed passage of the printer;

adjusting a gap to permit a single sheet to be advanced through the gap;

urging the stack of sheets toward a guide post having a concave radius of curvature configured to curve toward the gap thereby separating the stack into single sheets as they approach the gap.

16. A method for feeding an uneven stack of sheets into a printer, the method comprising:

physically associating an autonomous sheet feeder adjacent a printer;

loading a plurality of sheets into a pivotable tray in the sheet feeder, the sheets having side edges and one of the side edges has a cross sectional thickness that is greater than a cross sectional thickness of another of the side edges so that a stack is higher on one side than another, the stack of sheets slants horizontally from a thick side to a thin side;

biasing the tray so that the tray is vertically inclined toward an infeeder of the printer;

adjusting a gap to permit the side edge having a greater cross sectional thickness of a single sheet to be advanced through the gap;

guiding a sheet into the gap with a guide post having a radius of curvature configured to curve toward the gap; and driving the sheet forward into the infeed passage at the thick side, wherein upon passing through the gap, a guide rail on the thin side of the stack guides each sheet upward along an incline to horizontally align the sheet with the infeed of the printer.

17. A system for printing an uneven stack of sheets, the system comprising: a uneven stack of sheets, the stack of sheets having a greater cross sectional thickness along a first side than along a second side;

a printer; and an autonomous sheet feeder physically associated adjacent the printer;

the sheet feeder comprising:

a pivotable tray that may be biased so that the tray is vertically inclined toward an infeeder of the printer to horizontally align the stack of sheets with the infeeder of the printer;

an adjustable gap configured to permit a single sheet to be advanced through the gap;

a guide post having a radius of curvature configured to curve toward the gap to guide a single sheet toward the gap; and a sensor for detecting when the printer may receive a sheet for printing, wherein the sheet feeder urges a single sheet at a time into the infeeder of the printer.

18. A sheet feeder for a printer comprising: a feeder tray for holding a stack of sheets, said tray having a front edge to be positioned adjacent the printer; and a gate proximate said front edge, wherein the gate at least comprises a gate post proximate the front edge of the feeder tray, the gate post configured to guide the stack toward a gap configured to permit a single sheet to pass through the gap and wherein the gate post further having a radius of curvature provided in a surface adjacent the feeder tray to align the sheets in the stack.

* * * * *